United States Patent [19]

Atkins et al.

[11] Patent Number: 4,570,602

[45] Date of Patent: Feb. 18, 1986

[54] FUEL RAIL

[75] Inventors: Terrance J. Atkins, Rochester; Martin J. Field, Churchville; Donald J. Lamirande, Spencerport, all of N.Y.

[73] Assignee: General Motors Corporation, Detroit, Mich.

[21] Appl. No.: 410,641

[22] Filed: Aug. 23, 1982

[51] Int. Cl.[4] ..... F02M 39/00

[52] U.S. Cl. ..... 123/468; 123/456; 137/883

[58] Field of Search ..... 123/468, 469, 470, 471, 123/472, 516, 514, 456; 137/883, 884, 269, 271

[56] References Cited

U.S. PATENT DOCUMENTS

| | | | |
|---|---|---|---|
| 2,706,620 | 4/1955 | Graves | 165/142 |
| 3,026,928 | 3/1962 | Phillips | 123/456 |
| 3,789,819 | 2/1974 | Moulds | 123/469 |
| 4,286,563 | 9/1981 | Fahim | 123/469 |
| 4,294,215 | 10/1981 | Hans | 123/470 |
| 4,307,693 | 12/1981 | Glockler | 123/470 |

FOREIGN PATENT DOCUMENTS

| | | | |
|---|---|---|---|
| 2073316 | 10/1981 | United Kingdom | 123/469 |

*Primary Examiner*—Carl Stuart Miller
*Attorney, Agent, or Firm*—C. K. Veenstra

[57] ABSTRACT

A compact central fuel rail supports injectors which deliver fuel to both banks of a V-engine. THe fuel rail is extruded with both fuel supply and fuel return passages, a single circular plug provides a closure for the associated ends of the passages, and a plug in the return passage limits interconnection of the passages.

2 Claims, 10 Drawing Figures

FUEL RAIL

TECHNICAL FIELD

This invention provides an improved fuel rail which supports injectors for delivering fuel to an engine.

BACKGROUND

Some fuel injection systems for automotive engines have a plurality of fuel injectors each of which delivers fuel to the inlet port of an associated engine combustion chamber. In some such systems, the fuel injectors are mounted in sockets of a fuel rail which has a passage to supply fuel to the injectors; the fuel rail simplifies installation of the fuel injectors and the fuel supply passage on the engine.

SUMMARY OF THE INVENTION

This invention provides an improved fuel rail suitable for delivering fuel to an automotive engine.

In a fuel rail according to a principal aspect of this invention, a single length of fuel rail supports injectors which deliver fuel to both banks of a V-engine. The fuel rail is located centrally on the engine and has a group of injectors which are canted to extend transversely leftwardly and downwardly toward one bank of the engine while the remainder of the injectors are canted to extend transversely rightwardly and downwardly toward the other bank of the engine. The fuel rail is secured to the engine with bolts which exert only a downward force on the fuel rail body but are effective to retain the canted injectors between the fuel rail and the engine. This invention therefore provides a fuel rail of unusually compact construction.

A fuel rail according to this invention also may have a fuel return passage as well as a fuel supply passage. In such a fuel rail, it is advantageous to provide a circular recess at the end of the fuel intersected by and encompassing the associated ends of the supply and return passages and to seal the recess with a plug which provides a single closure for the associated ends of both fuel passages. In some applications, however, the supply passage must be isolated from the return passage, and this invention accordingly makes provision for sealing the end of one fuel passage before the plug is installed to seal the recess and close off the end of both fuel passages.

The details of the preferred embodiment as well as other features and advantages of this invention are set forth in the remainder of the specification and are shown in the accompanying drawings.

THE PREFERRED EMBODIMENT

Figure 1:
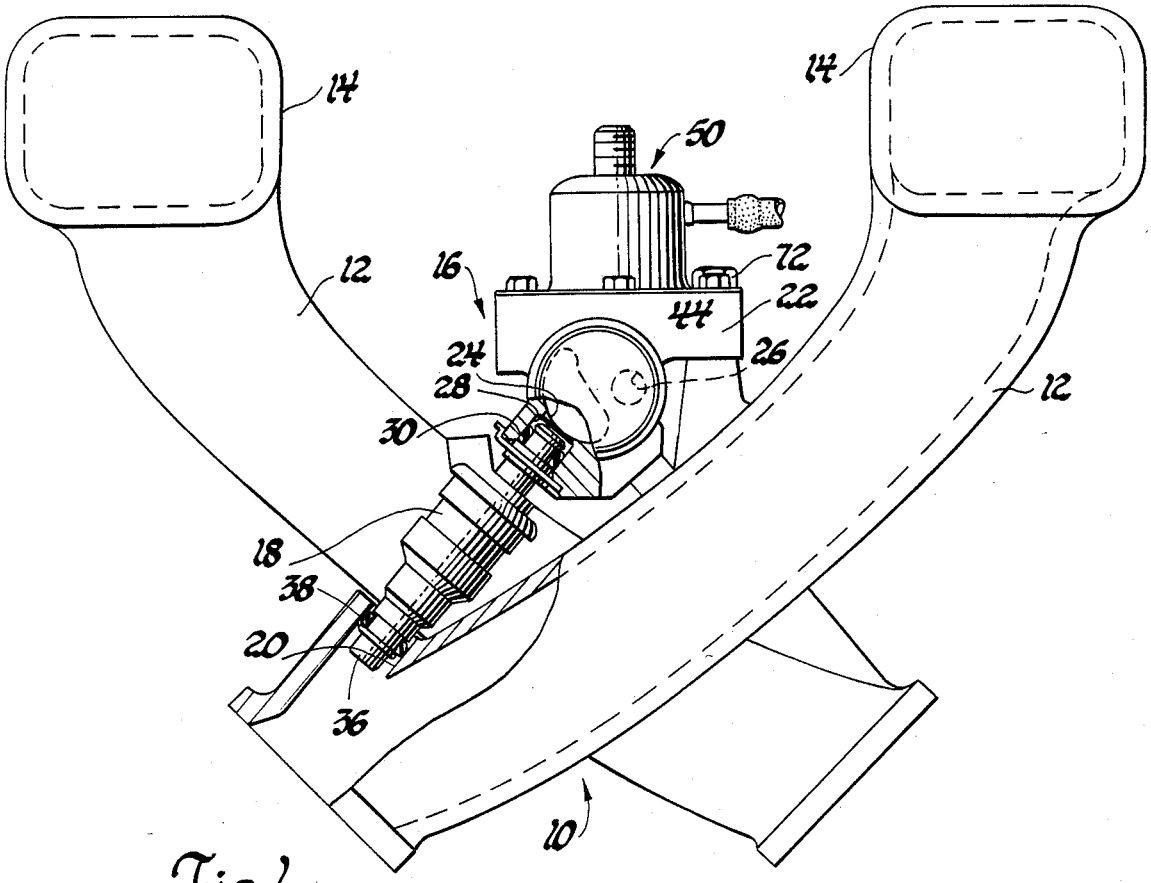
FIG. 1 is a rear view of a fuel rail according to this invention mounted on an engine manifold.

Referring to the drawings, the inlet manifold 10 of an automotive spark ignition V-6 engine has six ram tubes 12 extending from a pair of plenums 14 to the inlet ports for the engine combustion chambers (not shown). A fuel rail 16 is secured on manifold 10 and supports six injectors 18 each of which delivers fuel through an opening 20 in a ram tube 12 to one of the inlet ports.

Figure 2:
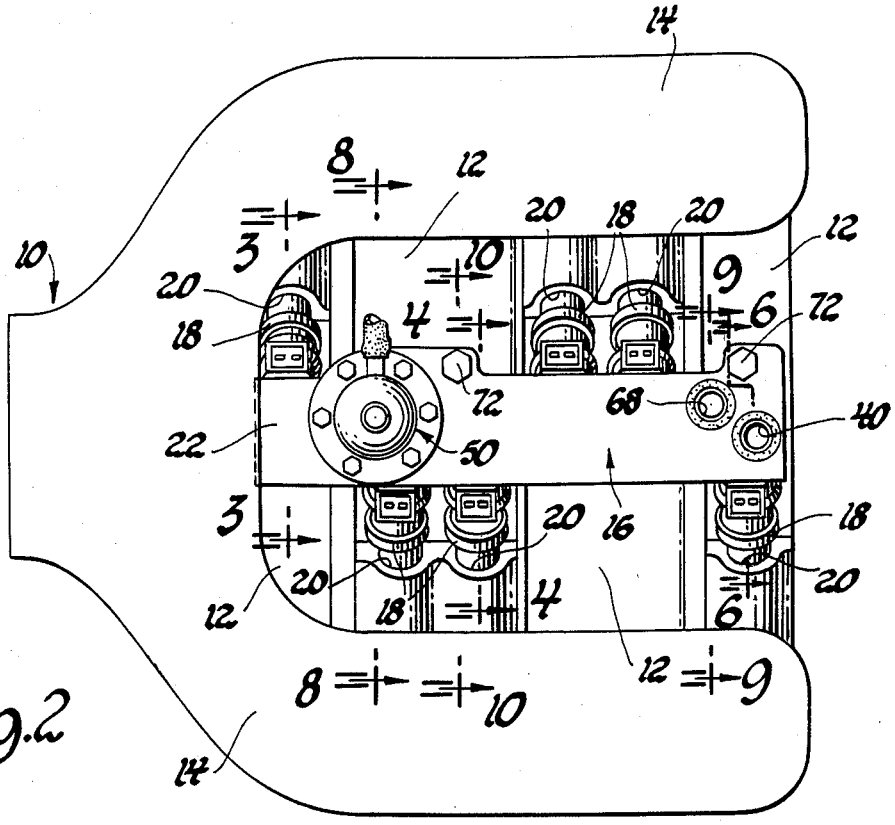
FIG. 2 is a plan view of the fuel rail and manifold of FIG. 1.

As shown in FIG. 2, the fuel injector openings 20 are arranged in two lines on opposite sides of the manifold, and some of the injectors 18 are canted to extend transversely leftwardly and downwardly toward one of the lines while the remainder of the injectors 18 are canted to extend transversely rightwardly and downwardly toward the other of the lines as shown in FIGS. 1, 3–4, 8 and 10.

Figure 3:
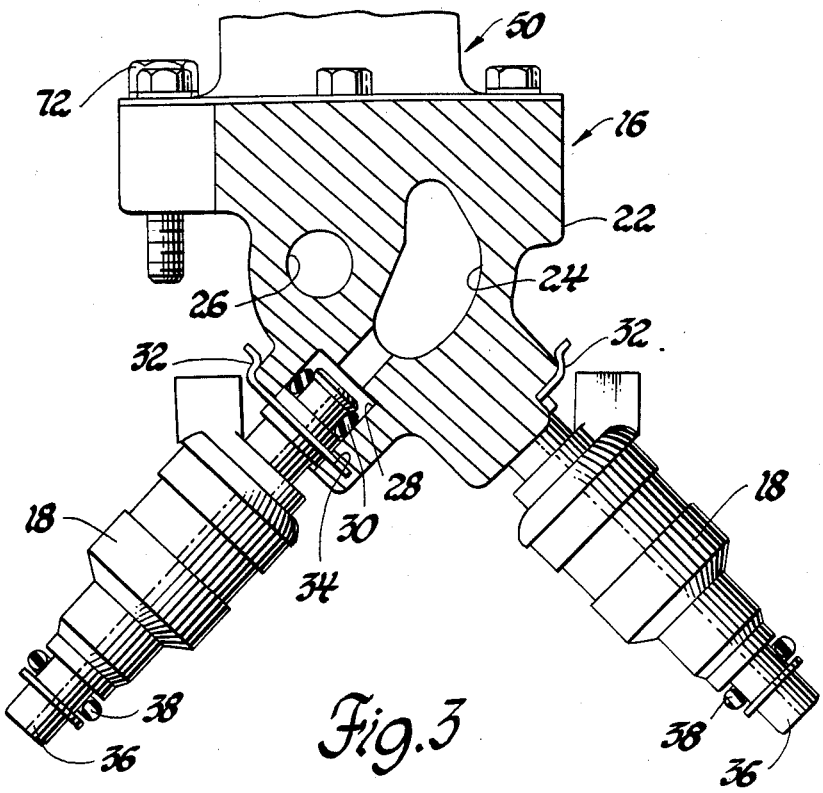
FIG. 3 is a sectional view indicated by the line 3—3 of FIG. 2 showing the interconnection of an injector and the fuel rail, the parts having been removed from the manifold.
Figure 4:
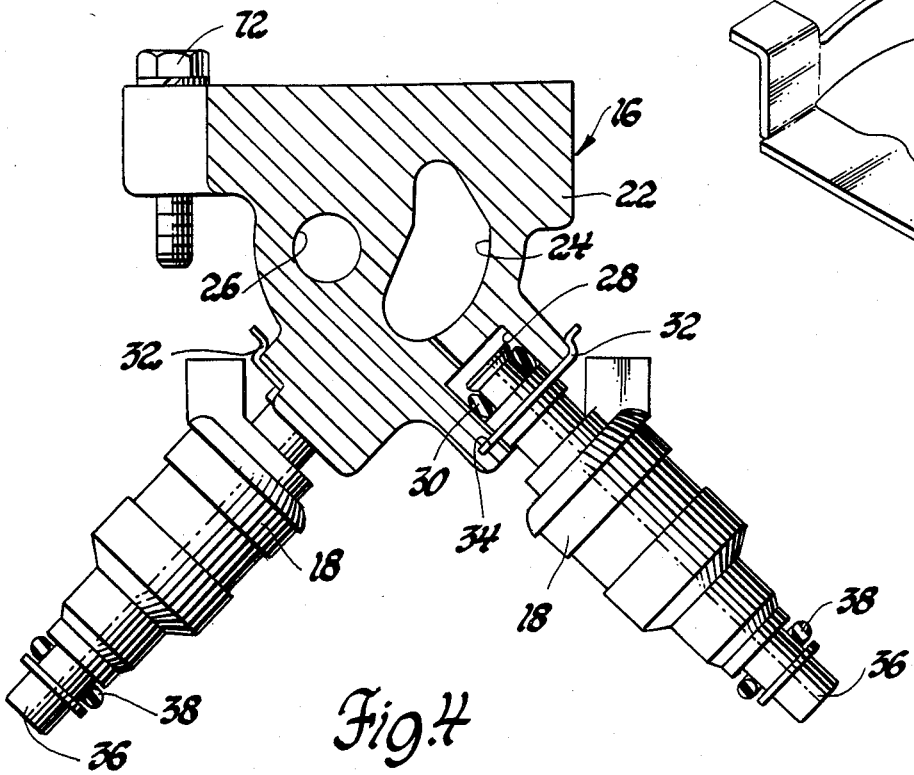
FIG. 4 is a sectional view indicated by the line 4—4 of FIG. 2 showing the interconnection of another injector and the fuel rail, the parts having been removed from the manifold.
Figure 5:
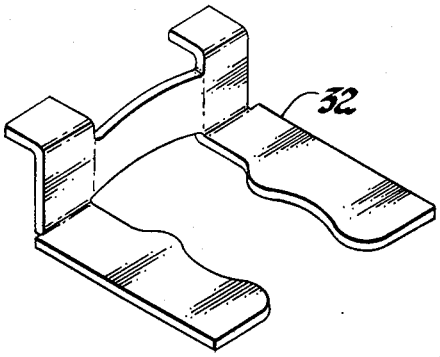
FIG. 5 is a view of a clip employed to secure each injector to the fuel rail.

Fuel rail 16 has an elongated body 22 extruded to form a fuel supply passage 24 and a fuel return passage 26. As shown in FIGS. 3 and 4, six injector sockets 28 machined in the fuel rail body 22 are intersected by the lower portion of fuel supply passage 24. Each socket 28 receives an injector 18, with an O-ring 30 sealing the injector-socket interconnection. Each injector 18 is retained in its socket 28 by a clip 32 which surrounds the injector and which is received in a slot 34 machined in the fuel rail body 22. The tip 36 of each injector 18 is received in the corresponding opening 20 in manifold 10 and has an O-ring 38 to seal the injector-manifold interconnection.

Figure 6:
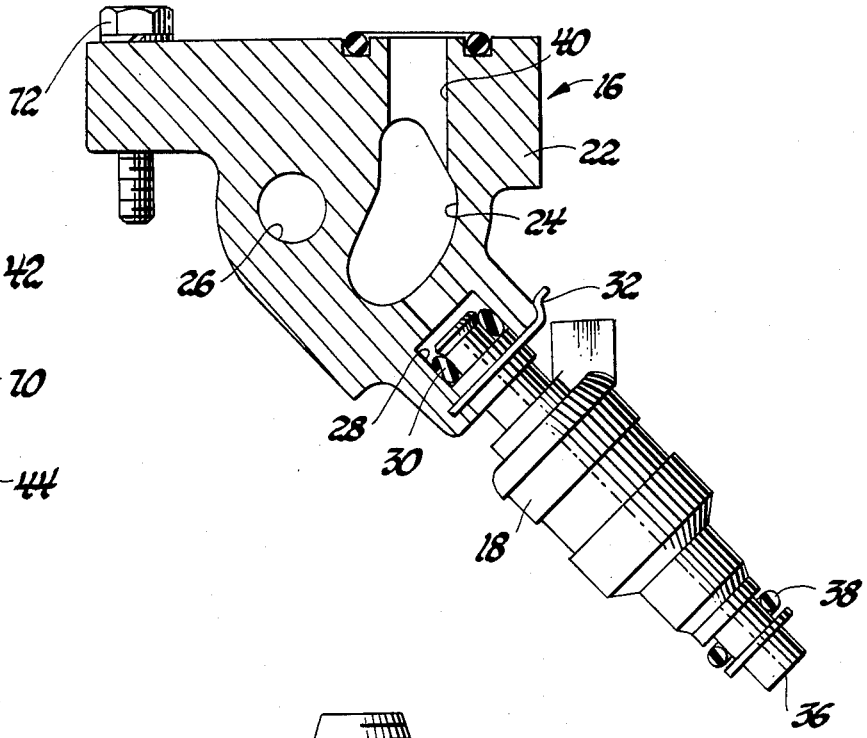
FIG. 6 is a sectional view indicated by the line 6—6 of FIG. 2 showing provision for connecting a fuel supply line to the fuel rail, the parts having been removed from the manifold.

Fuel rail 16 has a bore 40 (FIGS. 2 and 6) for connecting a fuel supply line (not shown) to fuel supply passage 24.

Figure 7:
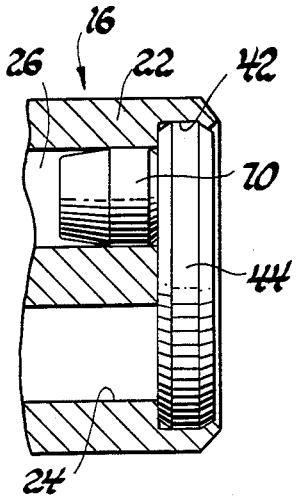
FIG. 7 is a view of one end of the fuel rail with parts broken away to show the plug which isolates the fuel supply passage from the fuel return passage and the plug which seals the recess and closes off both fuel passages.

As may be seen in FIG. 7, each end of the fuel rail body 22 has a circular recess 42 intersected by and encompassing the associated ends of fuel supply passage 24 and fuel return passage 26. Each recess 42 receives a circular plug 44 to provide a single closure for the associated ends of both fuel passages 24 and 26.

Figure 8:
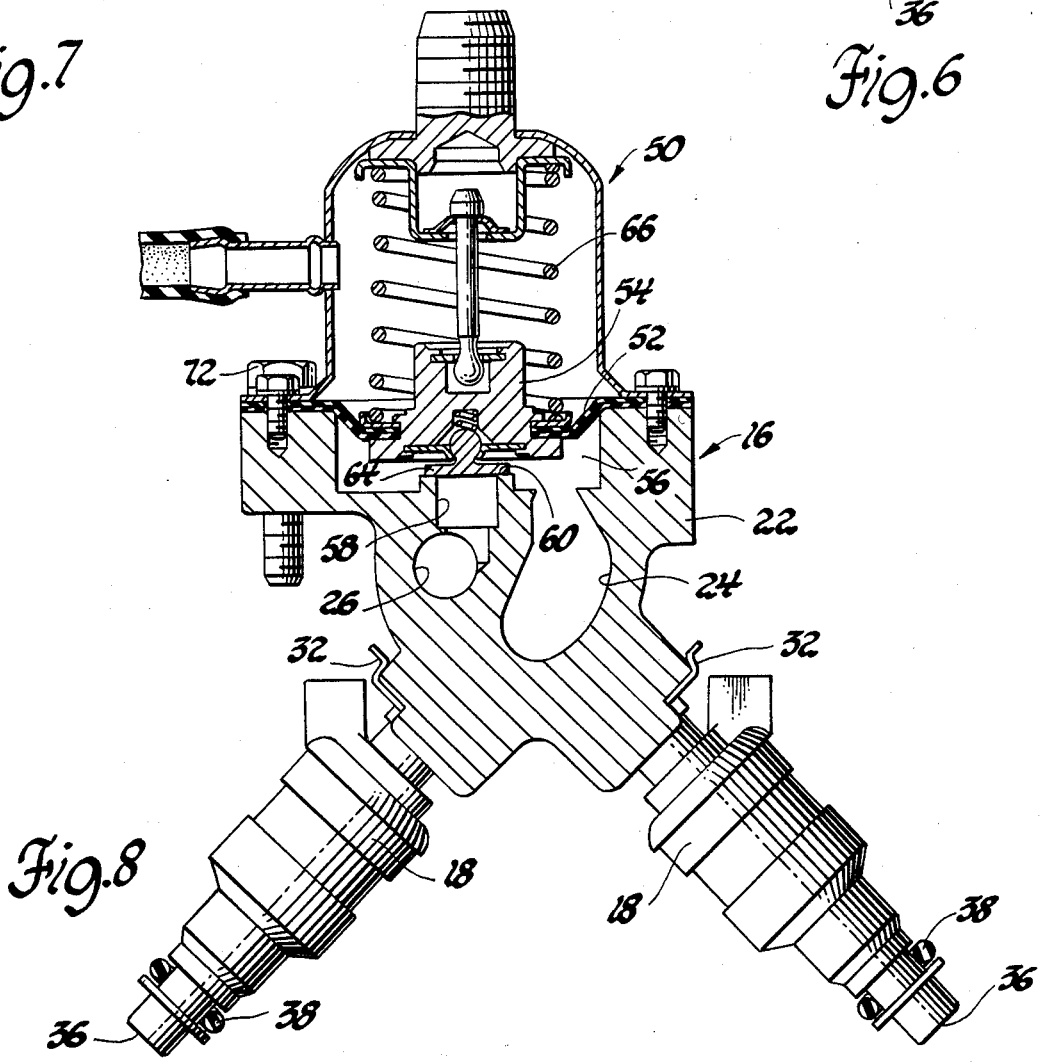
FIG. 8 is a sectional view indicated by the line 8—8 of FIG. 2 showing the fuel pressure regulator, the parts having been removed from the manifold.

As shown in FIG. 8, the body 22 of fuel rail 16 provides a base for a pressure regulator 50. Pressure regulator 50 has a pair of diaphragms 52 which overlie one another to form a single diaphragm unit and which are clamped to and carry a central diaphragm retainer plate 54. Diaphragms 52 overlie body 22 to define a fuel chamber 56. Fuel chamber 56 intersects fuel supply passage 24 so that fuel supply passage 24 opens to fuel chamber 56, and a fuel outlet 58 opens from fuel chamber 56 through a valve seat 60 to fuel return passage 26.

Chamber 56 and outlet 58 interconnect fuel supply passage 24 and fuel return passage 26 to allow fuel flow from supply passage 24 to return passage 26. Diaphragm retainer plate 54 carries a valve member 64 which cooperates with valve seat 60, and a spring 66 biases diaphragms 52 to engage valve member 64 with valve seat 60. Pressure regulator 50 controls fuel flow past valve seat 60 to balance the fuel pressure in chamber 56 on diaphragms 52 with the bias of spring 66 to thereby maintain a substantially constant fuel pressure in chamber 56 and thus in fuel supply passage 24.

Figure 9:
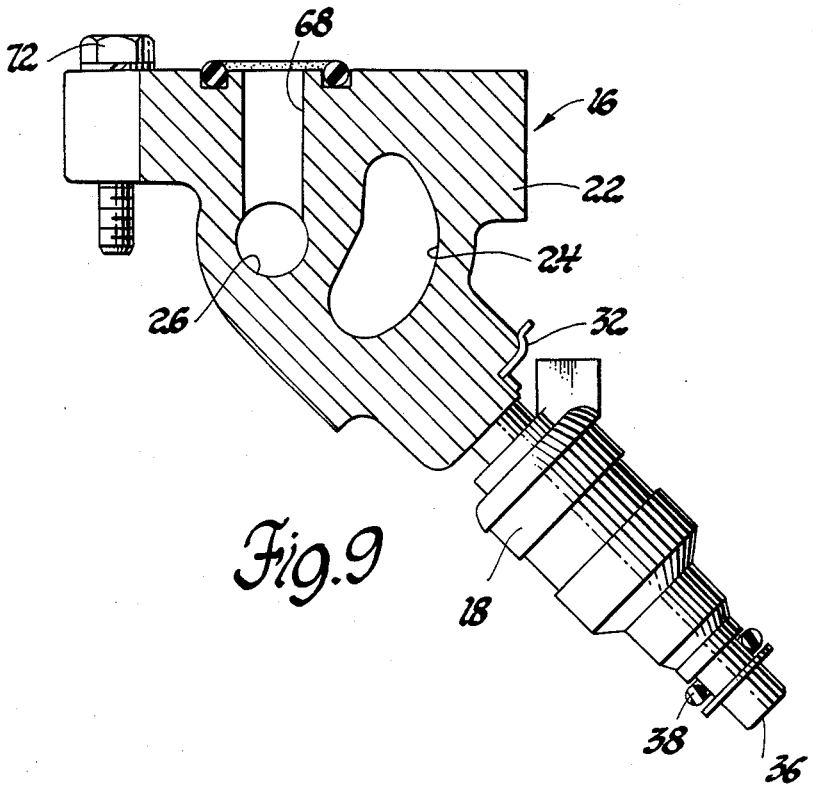
FIG. 9 is a sectional view indicated by the line 9—9 of FIG. 2 showing provision for connecting a fuel return line to the fuel rail, the parts having been removed from the manifold.

Fuel rail 16 has a bore 68 (FIGS. 2 and 9) for connecting fuel return passage 26 to a fuel return line (not shown).

Fuel injectors 18 preferably are conventional electromagnetic fuel injectors energized by a conventional electronic control unit (not shown). Each injector 18 receives fuel from its socket 28 and, when energized, delivers a timed pulse of fuel for mixture with the air which flows to the combustion chambers through manifold 10.

As may be seen from the drawings, the vertical dimension of fuel supply passage 24 substantially exceeds the horizontal dimension of fuel supply passage 24. Any fuel vapor entrained in the liquid fuel flowing through supply passage 24 thereby collects in the upper portion of supply passage 24, and injector sockets 28 receive only liquid fuel from the lower portion of supply passage 24.

The configuration of supply passage 24 is irregular, one side of supply passage 24 being outwardly convex and conforming substantially to the outline of recesses 42 at the ends of fuel rail 16. The other side of supply passage 24 is outwardly concave and embraces return passage 26. This construction provides a compact fuel rail permitting the smallest possible recesses 42 to encompass supply passage 24 and return passage 26.

Return passage 26 has a circular configuration and receives a circular plug 70 (FIG. 7) at each end of the fuel rail body 22. Plugs 70 isolate supply passage 24 from return passage 26 to limit or prevent fuel flow from supply passage 24 through recesses 42 to return passage 26.

Figure 10:
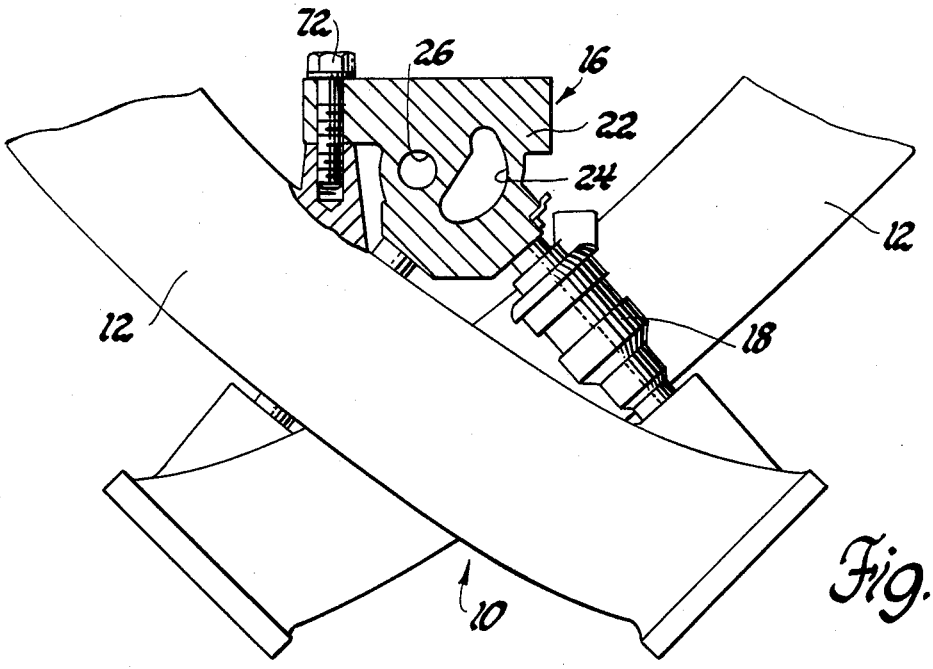
FIG. 10 is a sectional view indicated by the line 10—10 of FIG. 2 showing a bolt which secures the fuel rail to the manifold.

As shown in FIGS. 2 and 10, fuel rail 16 is secured to manifold 10 by a pair of bolts 72. Bolts 72 exert only a downward force on body 22 but are effective to retain the canted injectors 18 between the fuel rail 16 and the manifold 10.

Thus with this invention the fuel rail occupies only a portion of the space above the centerline of the engine. With this invention, moreover, only a few bolts (only two bolts in the illustrated embodiment) are required to mount both the fuel rail and the injectors on the engine.

It will be appreciated that each of the various features of the fuel rail depicted here may be used without employing all of the remaining features. In combination, however, they provide a fuel rail of particularly advantageous construction.

Features of the pressure regulator depicted here were invented by T. J. Atkins and M. J. Field and are claimed in copending application Ser. No. 410,651 filed Aug. 23, 1982. Other features employed in the fuel rail depicted here were invented by T. J. Atkins, M. J. Field and D. J. Lamirande as claimed in copending application Ser. No. 410,612, filed Aug. 23, 1982 and by L. J. Weinand as claimed in copending application Ser. No. 410,611, filed Aug. 23, 1982.

The embodiments of the invention in which an exclusive property or privilege is claimed are defined as follows:

1. A compact fuel rail for a V-engine having a plurality of fuel injector openings arranged in two lines, said fuel rail comprising an elongated body mountable above and between said lines and having a plurality of axially spaced fuel injector sockets and a pair of axially extending fuel passages, said fuel passages being interconnected and one of said passages intersecting said sockets for supplying fuel to said sockets, at least one end of said body having a circular recess intersected by and encompassing the associated ends of said fuel passages, one of said passages being circular in cross section, a circular plug received in said circular cross section passage adjacent said recess for limiting interconnection of said passages through said recess, a circular plug received in and sealing said recess to provide a closure for the associated ends of said passages, some of said sockets extending transversely leftwardly and downwardly toward one of said lines and the remainder of said sockets extending transversely rightwardly and downwardly toward the other of said lines, each of said sockets receiving a fuel injector suitable for delivering fuel from its socket through one of said openings, each of said injectors having a clip for securing said injector to said fuel rail, each of said injectors further having a tip adapted to be received in one of said openings, and means for securing said fuel rail to said engine above and between said lines by exerting only a downward force on said body to thereby retain said injectors between said fuel rail and the engine.

2. A fuel rail for an engine, said fuel rail comprising an elongated body having a plurality of axially spaced transversely extending fuel injector sockets and a pair of transversely spaced axially extending fuel passages, said fuel passages being interconnected and one of said passages intersecting said sockets for supplying fuel to said sockets, each of said sockets being adapted to receive a fuel injector suitable for delivering fuel from its socket to the engine, and wherein at least one end of said body has a circular recess intersected by and encompassing the associated ends of said fuel passages, one of said passages is circular in cross section, a circular plug is received in said circular cross section passage adjacent said recess for limiting interconnection of said passages through said recess, and a circular plug is received in and seals said recess to provide a closure for the associated ends of said passages.

* * * * *